US009254657B1

(12) United States Patent
Takabe et al.

(10) Patent No.: US 9,254,657 B1
(45) Date of Patent: Feb. 9, 2016

(54) FLOW PATH COMPONENT, LIQUID DISCHARGE HEAD, AND LIQUID DISCHARGE APPARATUS

(71) Applicant: SEIKO EPSON CORPORATION, Tokyo (JP)

(72) Inventors: Motoki Takabe, Shiojiri (JP); Koji Asada, Azumino (JP); Hidemichi Furihata, Chino (JP); Hiroyasu Asakawa, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/838,638

(22) Filed: Aug. 28, 2015

(30) Foreign Application Priority Data

Sep. 1, 2014 (JP) ..... 2014-176910

(51) Int. Cl.
*B41J 2/045* (2006.01)
*B41J 2/14* (2006.01)

(52) U.S. Cl.
CPC ..... *B41J 2/1433* (2013.01); *B41J 2/14201* (2013.01); *B41J 2/14233* (2013.01)

(58) Field of Classification Search
CPC .. B41J 1/1433; B41J 1/14201; B41J 1/14233; B41J 1/1607; B41J 1/161; B41J 1/1612; B41J 1/14274
See application file for complete search history.

(56) References Cited

U.S. PATENT DOCUMENTS

| | | | | |
|---|---|---|---|---|
| 7,914,116 | B2 * | 3/2011 | Suzuki | B41J 2/14274 347/45 |
| 2006/0042435 | A1 * | 3/2006 | Ogawa | B41J 2/1433 83/13 |
| 2008/0074472 | A1 * | 3/2008 | Takahashi | B41J 2/161 347/68 |
| 2015/0202875 | A1 | 7/2015 | Watanabe et al. | |

FOREIGN PATENT DOCUMENTS

| | | | |
|---|---|---|---|
| JP | 2014-037133 | A | 2/2014 |
| WO | WO2014027455 | A | 2/2014 |

* cited by examiner

*Primary Examiner* — Juanita D Jackson
(74) *Attorney, Agent, or Firm* — Workman Nydegger

(57) ABSTRACT

An inclined plane which inclines toward a lower plane of a ceiling portion, that is, the lower plane of a communication substrate from a ceiling plane of a second liquid chamber is formed in the second liquid chamber of the communication substrate. Therefore, an individual communication opening is formed, in a state of penetrating the communication substrate from the inclined plane. One end (lower end) of the individual communication opening communicates with the second liquid chamber by being open onto the inclined plane, and the other end (upper end) of the individual communication opening individually communicates with a pressure chamber of a pressure chamber forming substrate by being open onto an upper plane of the communication substrate. When a thickness of the communication substrate is referred to as T, a length of the individual communication opening is referred to as L, and a substantial depth of the second liquid chamber is referred to as D, the dimensions are configured so as to be L+D>T.

12 Claims, 11 Drawing Sheets

FLOW PATH COMPONENT, LIQUID DISCHARGE HEAD, AND LIQUID DISCHARGE APPARATUS

The entire disclosure of Japanese Patent Application No: 2014-176910, filed Sep. 1, 2014 is expressly incorporated by reference herein in its entirety.

BACKGROUND

1. Technical Field

The present invention relates to a flow path component which is used in a liquid discharge head such as an ink jet type recording head, and a liquid discharge apparatus, particularly, to a flow path component which is formed from a silicon substrate, a liquid discharge head, and a liquid discharge apparatus.

2. Related Art

A liquid discharge apparatus is an apparatus which includes a liquid discharge head, and discharges (ejects) various types of liquids from the discharge head. As such a liquid discharge apparatus, for example, there is an image recording apparatus such as an ink jet type printer or an ink jet type plotter, but recently, the liquid discharge apparatus is applied to various types of manufacturing apparatuses by using a feature of being able to accurately land the liquid of a very small amount at a predetermined position. For example, the liquid discharge apparatus is applied to a display manufacturing apparatus which manufactures a color filter such as a liquid crystal display, an electrode forming apparatus which forms an electrode such as an organic electro luminescence (EL) display or a field emission display (FED), or a chip manufacturing apparatus which manufactures a biochip (biotip). Therefore, a liquid ink is discharged in a recording head for the image recording apparatus, and a solution of each color material such as red (R), green (G) or blue (B) is discharged in a color material discharge head for the display manufacturing apparatus. Moreover, a liquid electrode material is discharged in an electrode material discharge head for the electrode forming apparatus, and a solution of a bio-organic matter is discharged in a bio-organic matter discharge head for the chip manufacturing apparatus.

In such a liquid discharge head, for example, a nozzle plate where a plurality of nozzles are installed, a substrate where a plurality of hollow portions to be a pressure chamber communicating with the respective nozzles are formed, a substrate where a flow path hollow portion to be a common liquid chamber (referred to as reservoir or manifold) in which the liquid being common to the respective pressure chambers is accumulated is formed, a plurality of piezoelectric elements (one type of actuators) which are respectively arranged correlating with the respective pressure chambers and the like are included. In such a configuration, since a flow path and the like can be formed by an etching highly accurately, a silicon substrate (silicon single crystal substrate) is adopted, as a material of the substrate which forms the flow path (for example, see JP-A-2014-037133).

In the configuration which is disclosed in JP-A-2014-037133, as illustrated FIG. 12, among a communication substrate 64 where the flow path hollow portion of the common liquid chamber is formed, a hollow is made by the etching in the middle of a substrate thickness direction toward an upper plane side from a lower plane of the communication substrate 64, and thereby, a hollow portion (referred to as liquid chamber hollow portion, hereinafter) 65 being a portion of the common liquid chamber is formed. Moreover, in the communication substrate 64, an individual communication opening 66 which penetrates the upper plane of the communication substrate 64 from the common liquid chamber is formed, in order that the common liquid chamber individually communicates with the respective pressure chambers. The individual communication opening 66 functions as a flow path of individually supplying the ink to the pressure chamber from the common liquid chamber side. In addition thereto, the individual communication opening 66 is a portion relating to discharge efficiency at the time of discharging the ink from the nozzle by driving the actuator. Hence, a flow path sectional area (hole diameter) or a flow path length is designed, so that flow path resistance, inertance or the like is suitable in the individual communication opening 66. Since a hole diameter X of the individual communication opening 66 is determined to a degree being the minimum value depending on a processing method, in general, a full length L' of the individual communication opening 66 is mainly adjusted, so that the inertance or the like becomes the suitable value after the hole diameter X is determined to be fixed.

However, if the length L' of the individual communication opening 66 is set to be suitable, since a depth D of the liquid chamber hollow portion 65 tends to be shallow along therewith, that is, since the flow path sectional area of the liquid chamber hollow portion 65 becomes small, the flow path resistance becomes significant in the liquid chamber hollow portion 65, and hereby, there is a tendency that a pressure loss is increased. In contrast, when the depth D of the liquid chamber hollow portion 65 is secured in order to suppress pressure loss, the length L' of the individual communication opening 66 is insufficient.

SUMMARY

An advantage of some aspects of the invention is to provide a flow path component, a liquid discharge head, and a liquid discharge apparatus which can secure a necessary length of an individual communication opening.

According to an aspect of the invention, there is provided a flow path component including: a flow path hollow portion that is formed by making a hollow in the middle of a plate thickness direction toward a second plane side of the opposite side of a first plane of a silicon substrate; and an individual flow path that penetrates the silicon substrate on the second plane side from the flow path hollow portion, in which a sum of a length L of the individual flow path and a substantial depth D of the flow path hollow portion in the thickness direction of the silicon substrate is greater than a thickness T of the silicon substrate.

In this case, the sum of the length L of the individual flow path and the substantial depth D of the flow path hollow portion in the thickness direction of the silicon substrate is configured so as to be greater than the thickness T of the silicon substrate, and thereby, it is possible to achieve both of the securing of the necessary depth D of the flow path hollow portion and the securing of the necessary length L of the individual flow path. Hence, since the necessary depth D of the flow path hollow portion may be secured while the flow path resistance or the inertance of the individual flow path may be suitably adjusted, it is possible to suppress pressure loss in the flow path hollow portion.

According to the aspect, it is preferable that the flow path hollow portion includes an inclined plane which inclines toward the first plane from a bottom plane of the second plane side, and one end of the individual flow path is open onto the inclined plane.

In this case, it is possible to set the length L of the individual flow path to be arbitrary, that is, to the necessary length L, by adjusting the opening position of the individual flow path on the inclined plane without depending on the depth D of the flow path hollow portion. Hence, it is possible to suitably adjust the flow path resistance or the inertance of the individual flow path. On the other hand, since the necessary depth D of the flow path hollow portion may be secured without depending on the length L of the individual flow path, it is possible to suppress pressure loss in the flow path hollow portion. Therefore, by adopting such a configuration, since both of the securing of the necessary length L of the individual flow path and the securing of the necessary depth D of the flow path hollow portion may be achieved even when the thickness of the flow path component tends to be thinner, it is possible to respond to the miniaturization of the liquid discharge head to which the flow path component is mounted.

Moreover, by the configuration that the inclined plane is arranged in the flow path hollow portion, and one end of the individual flow path is open onto the inclined plane, the flow path sectional area of the flow path hollow portion has a shape which becomes gradually narrow toward the individual flow path. Hereby, a flow velocity of the liquid flowing toward the individual flow path is increased. Hereby, it is possible to improve dischargeability of an air bubble in the flow path hollow portion.

According to the aspect, it is preferable that the silicon substrate is a substrate of which the first plane and the second plane are used as a (110) plane, and the inclined plane is made by a (111) plane which inclines toward the (110) plane.

In this case, the (111) plane which is generated at the time of forming the flow path hollow portion by an anisotropic etching is made into the inclined plane, and thereby, it is possible to form the inclined plane without separately adding a process.

According to the aspect, it is preferable that a relationship between a distance d which is up to a central axis of the individual flow path from the end of the individual flow path side in the flow path hollow portion and the substantial depth D of the flow path hollow portion is obtained by the following equation.

$$d \leq 1.73D$$

In this case, it is possible to suitably determine the forming position of the individual flow path, on the basis of the necessary depth D of the flow path hollow portion.

According to another aspect of the invention, there is provided a liquid discharge head including: the flow path component according to any of the aspects described above; and a pressure chamber forming member where a pressure chamber communicating with a nozzle is formed, in which the individual flow path communicates with the pressure chamber, and a liquid from the flow path hollow portion is supplied to the pressure chamber through the individual flow path.

In this case, it is possible to set the length L of the individual flow path to be arbitrary, that is, to the necessary length L, by adjusting the opening position of the individual flow path on the inclined plane without depending on the depth D of the flow path hollow portion. Hence, it is possible to suitably adjust the flow path resistance or the inertance of the individual flow path. On the other hand, since the necessary depth D of the flow path hollow portion may be secured without depending on the length L of the individual flow path, it is possible to suppress pressure loss in the flow path hollow portion. Therefore, by adopting such a configuration, since both of the securing of the necessary length L of the individual flow path and the securing of the necessary depth D of the flow path hollow portion may be achieved even when the thickness of the flow path component tends to be thinner, it is possible to respond to the miniaturization of the liquid discharge head without lowering the discharge efficiency of the liquid.

According to still another aspect of the invention, a liquid discharge apparatus including the liquid discharge head described above.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments for carrying out the invention will be described with reference to the accompanying drawings. Furthermore, in the embodiments described hereinafter, various limitations are made as a suitable specific example of the invention, but the scope of the invention is not limited to the embodiments as long as the gist of particularly limiting the invention is not written in the following description. Moreover, the following description is performed by exemplifying an ink jet type printer (printer, hereinafter) to which an ink jet type recording head (recording head, hereinafter) being one type of a liquid discharge head is mounted as a liquid discharge apparatus of the invention.

Figure 1:
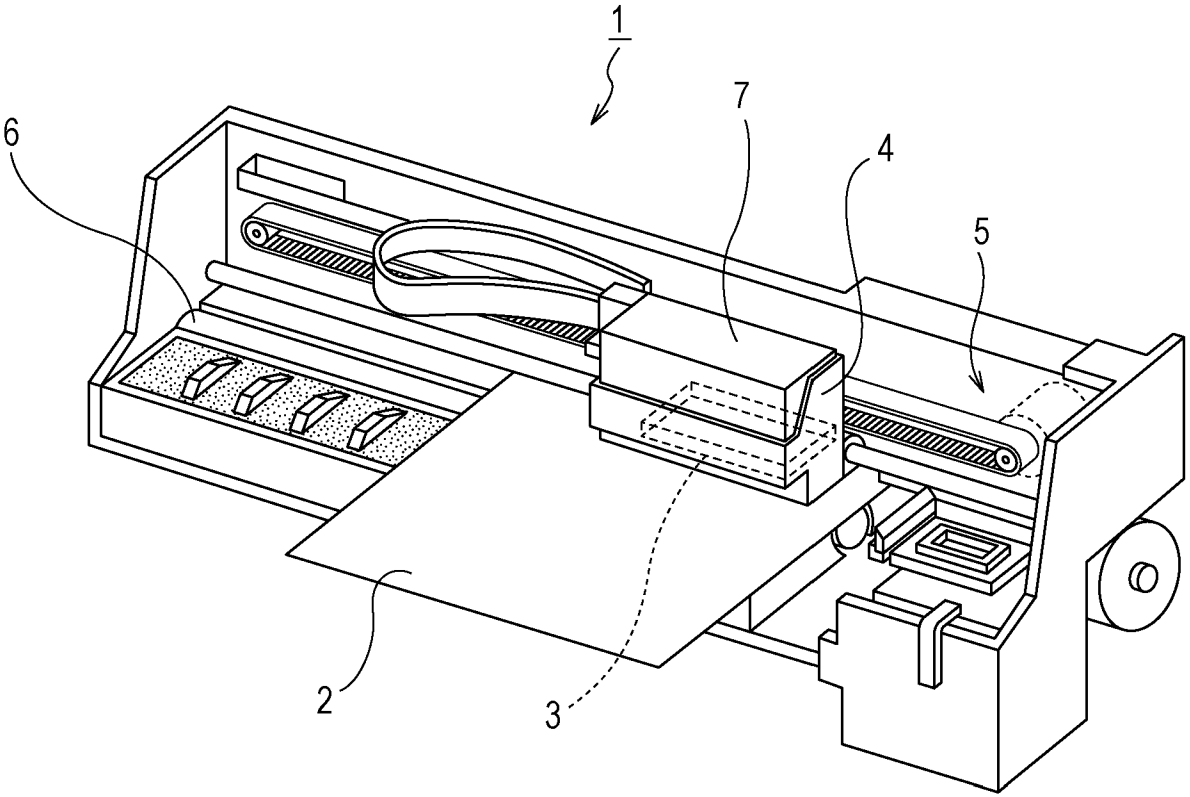
FIG. 1 is a perspective view for describing an inner configuration of a printer.

A configuration of a printer 1 will be described with reference to FIG. 1. The printer 1 is an apparatus which performs recording of an image or the like by discharging a liquid ink onto a surface of a recording medium 2 such as a recording sheet. The printer 1 includes a recording head 3 which discharges the ink, a carriage 4 to which the recording head 3 is attached, a carriage movement mechanism 5 which moves the carriage 4 in a main scan direction, and a platen roller 6 which transports the recording medium 2 in a sub-scan direction. Here, the ink is one type of a liquid, and is accumulated in an ink cartridge 7 as a liquid supply source. The ink cartridge 7 is detachably mounted to the recording head 3. Furthermore, it is possible to adopt the configuration that the ink cartridge 7 is arranged on a main body side of the printer 1, and the ink is supplied to the recording head 3 through an ink supply tube from the ink cartridge 7.

Figure 2:
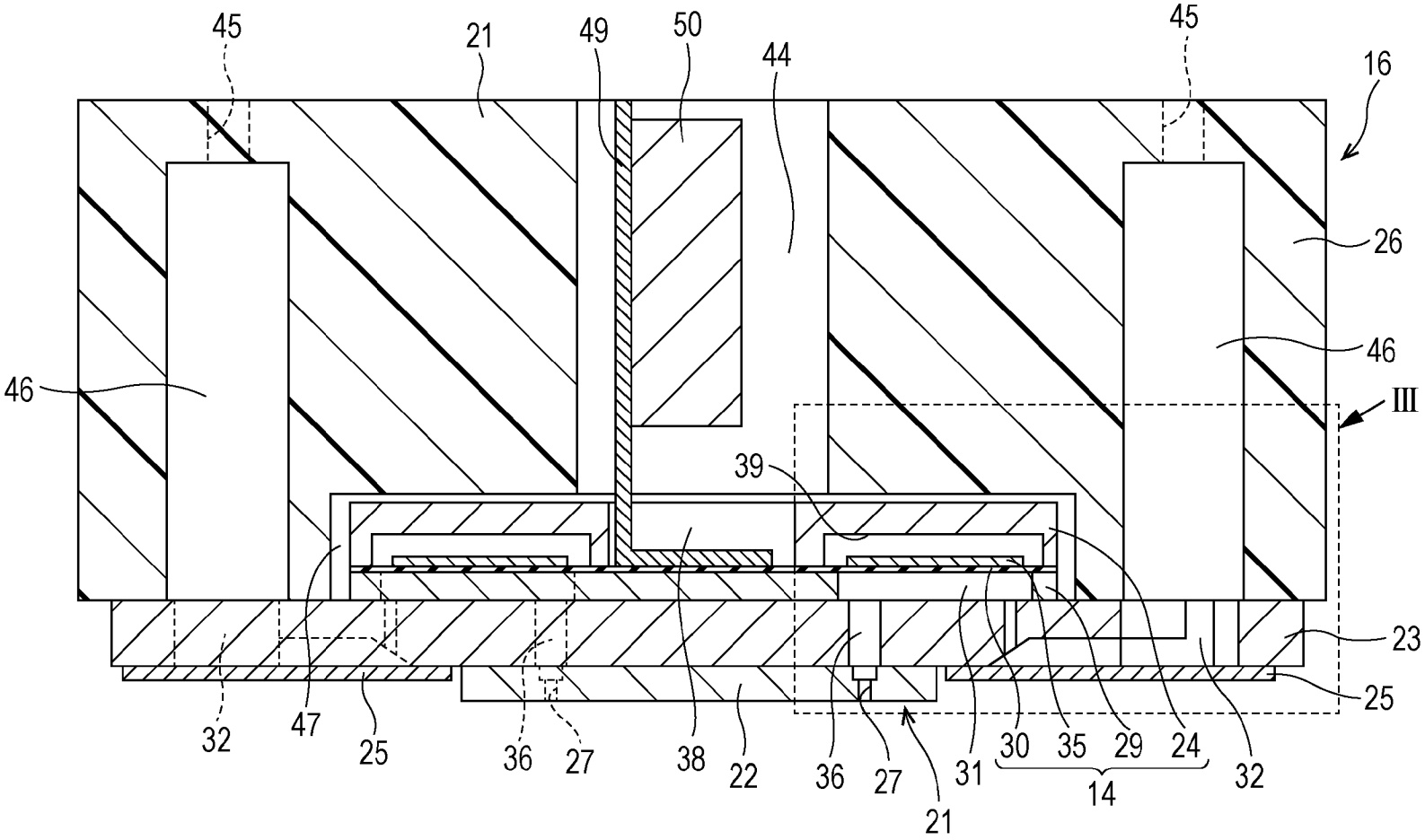
FIG. 2 is a sectional view of a recording head.
Figure 3:
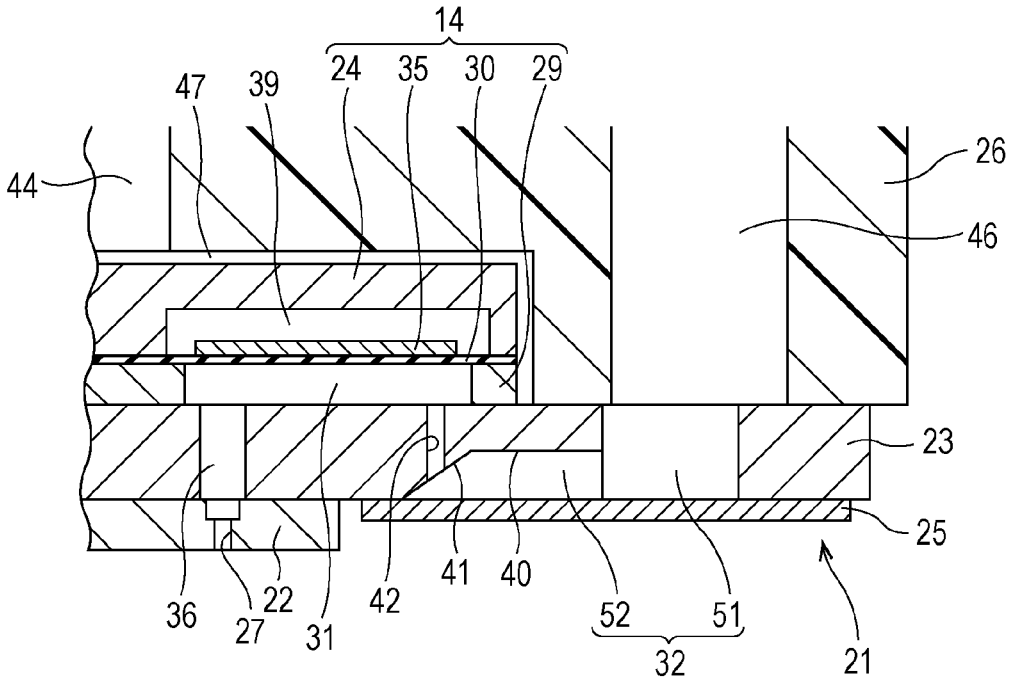
FIG. 3 is an enlarged sectional view of a certain region in FIG. 2.

FIG. 2 is a sectional view for describing a configuration of a main portion of the recording head 3. Moreover, FIG. 3 is an enlarged sectional view of a region III in FIG. 2. The recording head 3 of the embodiment includes a pressure generation unit 14, and a flow path unit 21, and is configured by attaching to a case 26 in a state where the members are stacked. The flow path unit 21 includes a nozzle plate 22, a compliance sheet 25, and a communication substrate (correlating with flow path component in the invention) 23. Moreover, the pressure generation unit 14 is a unit which is made by stacking a pressure chamber forming substrate 29 where a pressure chamber 31 is formed, an elastic film 30, a piezoelectric element (actuator) 35, and a protection substrate 24.

The case 26 is a box-shaped member that is manufactured by a synthetic resin, and is obtained by fixing the communication substrate 23 to which the nozzle plate 22 and the pressure generation unit 14 are bonded onto a bottom plane side. A through hollow portion 44 which includes a long rectangle-shaped opening along a nozzle array direction at a center portion among the case 26 in a planar view, is formed in the state of penetrating the case 26 in a height direction. The through hollow portion 44 communicates with a wiring hollow portion 38 of the pressure generation unit 14, and forms a hollow portion where one end portion of a wiring member (flexible cable 49) and a drive IC 50 are accommodated. Moreover, an accommodation hollow portion 47 which is obtained by making a hollow into a rectangular parallelepiped shape in the middle of the height direction of the case 26 from the lower plane, is formed on a lower plane side of the case 26. If the flow path unit 21 is bonded to the lower plane of the case 26 in the state of determining a position, the pressure generation unit 14 which is stacked on the communication substrate 23 is configured so as to be accommodated in the accommodation hollow portion 47. Still more, a lower end of the through hollow portion 44 is open onto a ceiling plane of the accommodation hollow portion 47.

An ink introduction hollow portion 46 and an ink introduction path 45 are formed in the case 26. The ink introduction path 45 is a narrow flow path of which a sectional area is set to be small in comparison with the ink introduction hollow portion 46, and supplies the ink to the ink introduction hollow portion 46 from the ink cartridge 7 side. The ink flowing into the ink introduction hollow portion 46 is introduced into a common liquid chamber 32 (described later) of the communication substrate 23.

The pressure chamber forming substrate 29 being a configuration member of the pressure generation unit 14, is manufactured from a silicon single crystal substrate (one type of crystalline substrate. Hereinafter, the silicon single crystal substrate is simply referred to as the silicon substrate). In the pressure chamber forming substrate 29, a plurality of hollow portions (referred to as the pressure chamber 31 as including the hollow portion, hereinafter) to be a plurality of pressure chambers 31 by an anisotropic etching with respect to the silicon substrate are formed correlating with a plurality of nozzles 27 of the nozzle plate 22. In this manner, the pressure chamber is formed by the anisotropic etching with respect to the silicon substrate, and thereby, it is possible to secure the higher accuracy in dimension and shape. As described later, since the arrays of the nozzles 27 are formed by two lines among the nozzle plate 22 in the embodiment, the arrays of the pressure chambers 31 are formed by two lines correlating with each nozzle array among the pressure chamber forming substrate 29. The pressure chamber 31 is a hollow portion that is elongated in a direction which is orthogonal to the nozzle array direction. If the pressure chamber forming substrate 29 is bonded to the communication substrate 23 in the state of determining the position, one end portion of a longer direction of the pressure chamber 31 communicates with the nozzle 27 through a nozzle communication path 36 of the communication substrate 23 described later. Moreover, the other end portion of the longer direction of the pressure chamber 31 communicates with the common liquid chamber 32 through an individual communication opening 42 (correlating with an individual flow path in the invention) of the communication substrate 23.

On an upper plane (plane of an opposite side to the plane which is bonded to the communication substrate 23) of the pressure chamber forming substrate 29, the elastic film 30 is formed in the state of sealing an upper opening of the pressure chamber 31. For example, the elastic film 30 is configured from a silicon dioxide of which a thickness is approximately 1 μm. Moreover, an insulating film which is not illustrated is formed on the elastic film 30. For example, the insulating film is made up of a zirconium oxide. Therefore, the piezoelectric elements 35 are respectively formed at the positions correlating with the respective pressure chambers 31 on the elastic film 30 and the insulating film. The piezoelectric element 35 of the embodiment is a piezoelectric element of a so-called bending mode. The piezoelectric element 35 is configured by being appropriately patterned per the pressure chamber 31 after a lower electrode film which is manufactured by a metal, a piezoelectric body layer which is made up of lead zirconate titanate (PZT) or the like, and an upper electrode film which is manufactured by a metal (all are not illustrated) are sequentially stacked on the elastic film 30 and the insulating film. Therefore, one of the upper electrode film and the lower electrode film is used as a common electrode, and the other is used as an individual electrode. Moreover, the elastic film 30, the insulating film, and the lower electrode film function as a vibration plate at the time of driving the piezoelectric element 35.

From the individual electrode (upper electrode film) of each piezoelectric elements 35, an electrode wiring portion which is not illustrated is respectively extended within the wiring hollow portion 38, and a terminal of one end side of the flexible cable 49 is connected to a portion correlating with an electrode terminal of the electrode wiring portion. On the surface of the flexible cable 49, the drive IC 50 which drives the piezoelectric element 35 is mounted. Each piezoelectric element 35 is modified into a bending shape by applying a drive signal (drive voltage) between the upper electrode film and the lower electrode film through the drive IC 50.

The protection substrate 24 is arranged on the upper plane of the communication substrate 23 where the piezoelectric element 35 is formed. For example, the protection substrate 24 is manufactured from glass, a ceramic material, a silicon single crystal substrate, a metal, a synthetic resin or the like. On an inside of the protection substrate 24, a concave portion 39 having a size of a degree that does not inhibit the driving of the piezoelectric element 35 in a region which is positioned counter to the piezoelectric element 35 is formed. Furthermore, among the protection substrate 24, the wiring hollow portion 38 penetrating the substrate in a thickness direction is formed between the piezoelectric element arrays which are adjacent to each other. On the inside of the wiring hollow portion 38, the electrode terminal of the piezoelectric element 35 and one end portion of the flexible cable 49 are arranged.

The nozzle plate 22 and the compliance sheet 25 are bonded onto the lower plane of the communication substrate 23. The nozzle plate 22 is a plate member where the plurality of nozzles 27 are set up, and is bonded to the center portion of the lower plane of the communication substrate 23 in the state where each nozzle 27 respectively communicates with the nozzle communication path 36 of the communication substrate 23. Among the nozzle plate 22, the nozzle array is formed by arranging the plurality of nozzles 27 in parallel by a predetermined pitch. In the embodiment, the nozzle array of two lines is formed among the nozzle plate 22. Moreover, the nozzle plate 22 is manufactured from the silicon substrate. Therefore, the nozzle 27 of a cylinder shape is formed by performing a dry etching with respect to the substrate. The compliance sheet 25 is a member having flexibility which is bonded onto the lower plane of the communication substrate 23 in the state of closing the opening of the common liquid chamber 32. The compliance sheet 25 performs a function of absorbing a pressure change of the ink within the common liquid chamber 32.

Figure 4:
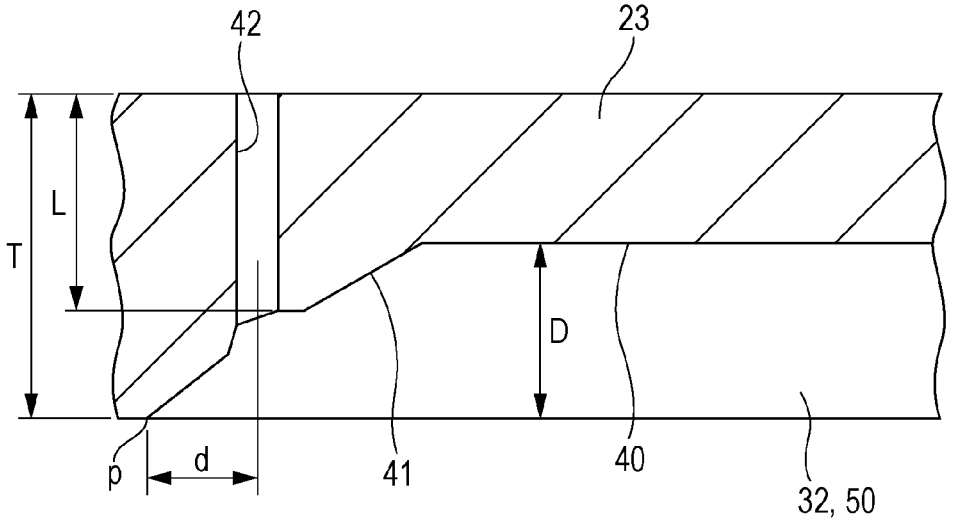
FIG. 4 is a sectional view of a main portion in the vicinity of an individual communication opening.
Figure 5:
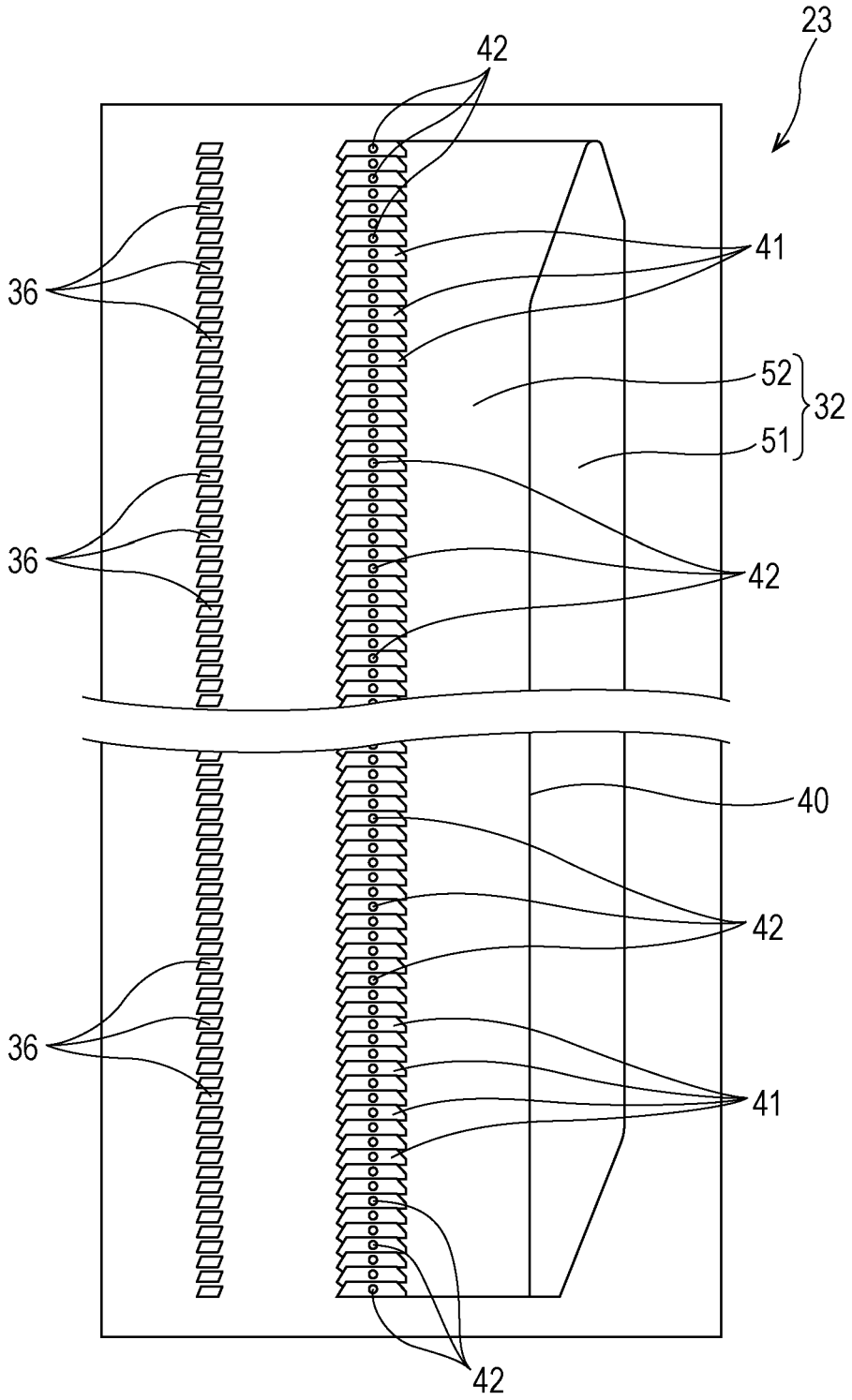
FIG. 5 is a plan view of a communication substrate.

FIG. 4 and FIG. 5 are views for describing the configuration of the communication substrate 23. FIG. 4 is a sectional view of a main portion in the vicinity of the individual communication opening 42. FIG. 5 is a plan view of the lower plane side of the communication substrate 23. The communication substrate 23 is a plate member which is manufactured from the silicon substrate which uses the surface (upper plane and lower plane) as a (110) plane. Among the communication substrate 23, a hollow portion to be the nozzle communication path 36 and the common liquid chamber 32 is formed by the anisotropic etching. The plurality of nozzle communication paths 36 correlating with the pressure chamber 31 are formed along a parallel arrangement direction (nozzle array direction) of the pressure chamber 31. In the state where the communication substrate 23 and the pressure chamber forming substrate 29 are bonded in the state of determining the positions, each nozzle communication path 36 communicates with one end portion in the longer direction of the pressure chamber 31 correlating with each nozzle communication path 36. The common liquid chamber 32 is a hollow portion which is long along the nozzle array direction (in other words, parallel arrangement direction of the pressure chamber 31). The common liquid chamber 32 is configured from a first liquid chamber 51 penetrating the communication substrate 23 in a plate thickness direction, and a second liquid chamber 52 which is formed by making a hollow due to the etching as described later in the middle of the plate thickness direction of the communication substrate 23 toward the upper plane (second plane of the invention) side from the lower plane (first plane of the invention) side of the communication substrate 23 in the state of leaving a ceiling portion 40 on the upper plane side.

The opening of the first liquid chamber 51 on the upper plane side of the communication substrate 23, communicates with the ink introduction hollow portion 46 which is formed in the case 26. Therefore, the ink from the ink introduction path 45 and the ink introduction hollow portion 46 side, flows into the first liquid chamber 51. The second liquid chamber (correlating with the flow path hollow portion of the invention) 52 is a hollow communicating with the first liquid chamber 51. While one end (end of the side which is distant from the nozzle 27) of the second liquid chamber 52 in the longer direction of the pressure chamber 31 communicates with the first liquid chamber 51, the other end (end of the individual flow path side in the invention) of the same direction is formed at the position correlating with the lower side of the pressure chamber 31. An inclined plane 41 which inclines toward the lower plane of the communication substrate 23 from the lower plane of the ceiling portion 40, that is, the ceiling plane (correlating with the bottom plane of the second plane side in the invention) of the second liquid chamber 52, is formed in the other end portion of the second liquid chamber 52. Therefore, in the state of penetrating the communication substrate 23 from the middle of the incline of the inclined plane 41, the individual communication opening 42 is formed. The plurality of individual communication openings 42 correlating with each pressure chamber 31 of the pressure chamber forming substrate 29 are formed along the nozzle array direction. One end (lower end) of the individual communication opening 42 communicates with the second liquid chamber 52 by being open in the middle of the incline of the inclined plane 41, and the other end (upper end) of the individual communication opening 42 individually communicates with the pressure chamber 31 of the pressure chamber forming substrate 29 by being open onto the upper plane of the communication substrate 23.

By adopting such the configuration, when a thickness of the communication substrate 23 is referred to as T, a length of the individual communication opening 42 is referred to as L, and a substantial depth of the second liquid chamber 52 is referred to D, the dimensions are made as follows.

$$L+D>T$$

Here, the "substantial depth of the second liquid chamber 52" means a depth of the main portion of the second liquid chamber 52 except for the portion where the inclined plane 41 is formed, specifically, a depth which is up to the ceiling plane (lower plane of the ceiling portion 40) of the second liquid chamber 52 from the lower plane of the communication substrate 23. Here, the ceiling plane of the second liquid chamber 52 is a plane which is parallel to the (110) plane, and is a portion which is utmostly eroded by the etching in the second liquid chamber 52. Therefore, the substantial depth is a depth of the deepest portion of the second liquid chamber 52.

Hereby, it is possible to achieve both of the securing of the necessary depth D of the second liquid chamber 52 among the common liquid chamber 32 and the securing of the necessary length L of the individual communication opening 42, as compared with a trade-off relationship in the configuration of the related art. In other words, it is possible to set the length L of the individual communication opening 42 to be arbitrary, that is, to the necessary length L, by adjusting the opening position of the individual communication opening 42 on the inclined plane 41 without depending on the depth D of the second liquid chamber 52. Hence, it is possible to suitably adjust flow path resistance or inertance of the individual communication opening 42. Here, if a section (opening) radius of the individual communication opening 42 is referred to as r, and viscosity of the ink is referred to as μ, and a density of the ink is referred to as ρ, a flow path resistance R and an inertance M are guided by the following approximate equation.

$$R=8\,\mu L/\pi r^4$$

$$M=\rho L/\pi r^2$$

Since the section of the individual communication opening 42 is determined to have the size of a certain degree by a working method, it is possible to adjust a balance between the flow path resistance and the inertance in the individual communication opening 42, by suitably setting the length L of the individual communication opening 42.

On the other hand, since the necessary depth D of the second liquid chamber 52 may be secured without depending on the length L of the individual communication opening 42, it is possible to suppress a pressure loss. Therefore, by adopting such the configuration, since both of the securing of the necessary length L of the individual communication opening 42 and the securing of the necessary depth D of the second liquid chamber 52 may be achieved even when the thickness T of the communication substrate 23 tends to be thinner, it is possible to respond to the miniaturization of the recording head 3 without lowering discharge efficiency of the liquid (that is, without having an influence on discharge properties).

Furthermore, regarding the forming position of the individual communication opening 42, it is preferable that a relationship (see FIG. 4) between a distance d which is up to a central axis of the individual communication opening 42 from the end of the individual communication opening 42 side in the second liquid chamber 52 and the depth D of the second liquid chamber 52 is obtained by the following equation.

$$d \leq 1.73D$$

Hereby, it is possible to suitably determine the forming position of the individual communication opening 42, on the basis of the necessary depth D of the second liquid chamber 52.

Moreover, by the configuration that a wedge-shaped hollow portion is made by arranging the inclined plane 41 in the end portion of the opposite side to the first liquid chamber 51 side among the second liquid chamber 52, and one end of the individual communication opening 42 is open in the middle of the inclined of the inclined plane 41, the flow path sectional area of the second liquid chamber 52 has a shape which becomes gradually narrow toward each individual communication opening 42 from the first liquid chamber 51 side in the inclined plane 41. Hereby, a flow velocity of the liquid flowing toward the individual communication opening 42 from the first liquid chamber 51 side (ink supply side) is increased. Hereby, it is possible to improve dischargeability of an air bubble in the second liquid chamber 52.

Furthermore, by forming the inclined plane 41, since the inclined plane 41 which uses an acute angle portion (see a sign p in FIG. 4 and FIG. 6A) of the opening on the individual communication opening 42 side in the second liquid chamber 52 as an inclined end (inclined lower end in FIG. 4) is formed, an acute angle groove-shaped path (portion where inner walls configuring the second liquid chamber 52 intersect with the acute angle) is not generated in a corner of the second liquid chamber 52. Hereby, since capillarity is unlikely to be generated even when an adhesive leaks out from the bonding portion between the communication substrate 23 and the compliance sheet 25 by any chance, it is possible to suppress a capillary rise of the adhesive. Hereby, a failure such that the adhesive closes the individual communication opening 42 is prevented.

Next, a forming process of the second liquid chamber 52 and the individual communication opening 42 in the communication substrate 23, will be described on the basis of FIG. 6A to FIG. 11C. Furthermore, the respective drawings are illustrated by being divided as follows. FIGS. 6A, 7A, 8A, 9A, 10A and 11A are plan views of the vicinity of the forming position of the individual communication opening 42 in the communication substrate 23, and FIGS. 6B, 7B, 8B, 9B, 10B and 11B are sectional views taken along VIB-VIB, VIIB-VIIB, VIIIB-VIIIB, IXB-IXB, XB-XB, and XIB-XIB lines in the respective FIGS. 6A, 7A, 8A, 9A, 10A and 11A, and FIGS. 6C, 7C, 8C, 9C, 10C and 11C are sectional views taken along VIC-VIC, VIIC-VIIC, VIIIC-VIIIC, IXC-IXC, XC-XC, and XIC-XIC lines in the respective FIGS. 6A, 7A, 8A, 9A, 10A and 11A.

Figure 6A:
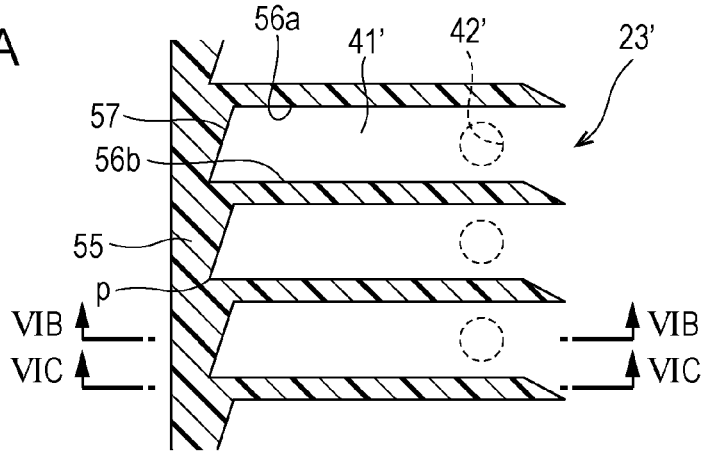
FIGS. 6A to 6C are views for describing a forming process of a second liquid chamber and the individual communication opening in the communication substrate.
Figure 6B:
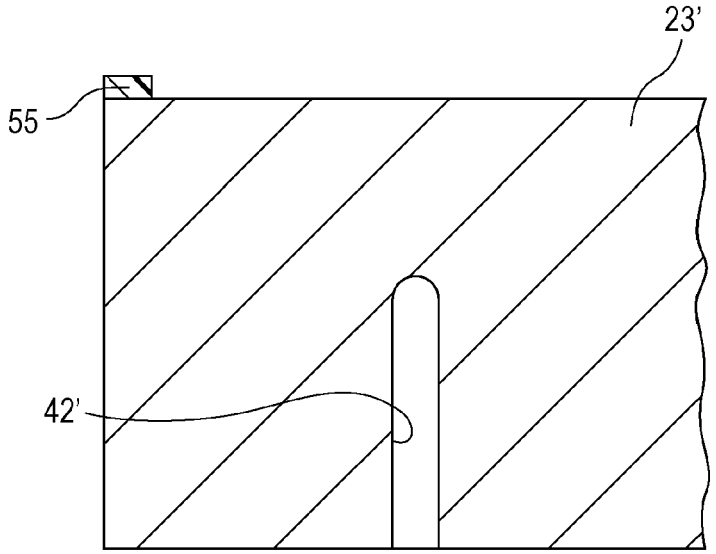

First, as illustrated in FIG. 6B, a prepared hole 42' to be the individual communication opening 42 is formed in a forming prearranged position of the individual communication opening 42, from one plane (that is a plane of the side which is bonded to the pressure chamber forming substrate 29, and correlate with the second plane in the invention) of a silicon wafer being a base material 23' of the communication substrate 23 (first process). For example, the prepared hole 42' is bored in the middle of the base material 23' in the thickness direction, by an etching method such as a Bosch process. In other words, the prepared hole 42' is formed while an etching by plasma, and a protective film forming process of an inner peripheral wall of the hole are sequentially repeated. The depth of the prepared hole 42' is adjusted so as to be slightly deeper than the length L which is necessary as an individual communication opening 42. Furthermore, the forming method of the prepared hole 42' is not limited to the examples. Various types of methods such as a method using a laser beam may be adopted, but it is preferable that the depth of the prepared hole 42' may be adjusted to be arbitrary.

Figure 6C:
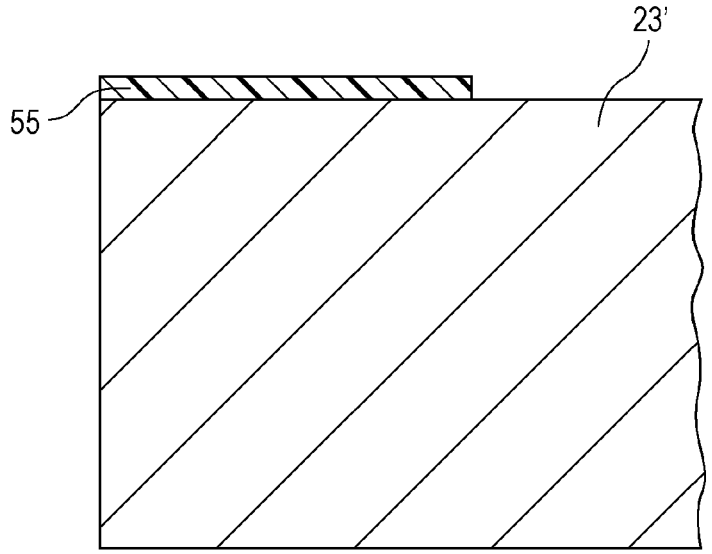

Next, a silicon oxide film (simply referred to as oxide film, hereinafter) is formed by a thermal oxidation treatment on the other plane (that is a plane of the side which is bonded to the nozzle plate 22 and the compliance sheet 25, and correlates with the first plane in the invention) of the base material 23'. The film is not limited to the silicon oxide film. For example, a nitride film or the like may be used, if it functions as a resist with respect to an etching solution at the time of the etching. Thereafter, as illustrated in FIG. 6A to FIG. 6C, a resist pattern 55 is arranged on the oxide film by passing through exposure and development through a mask (second process). Here, in the resist pattern 55, by a pair of first division patterns 56*a* and 56*b* that are parallel to a first (111) plane which is orthogonal to the (110) plane being the surface of the base material 23' and the nozzle array direction (upper and lower direction in FIG. 6A), and a second division pattern 57 along a second (111) plane which is orthogonal to the (110) plane being the surface of the base material 23' and inclines to the first (111) plane, the resist pattern 55 surrounding a forming prearranged position (referred to as inclined plane forming prearranged position, hereinafter) 41' of the inclined plane 41 from three directions is formed per the forming prearranged position of the individual communication opening 42.

Figure 7A:
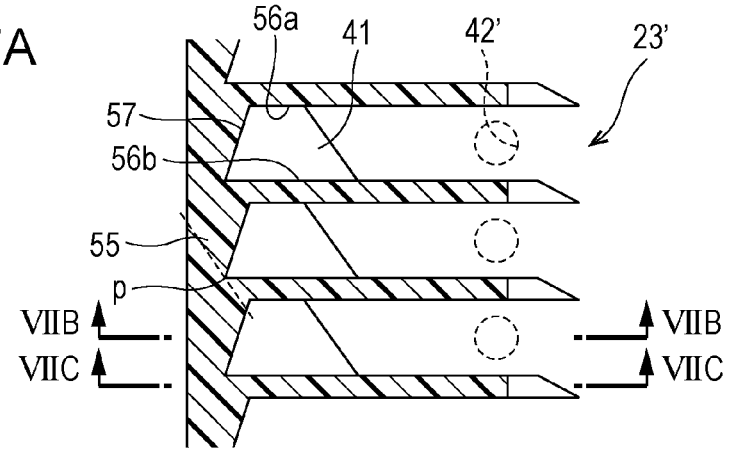
FIGS. 7A to 7C are views for describing the forming process of the second liquid chamber and the individual communication opening in the communication substrate.
Figure 7B:
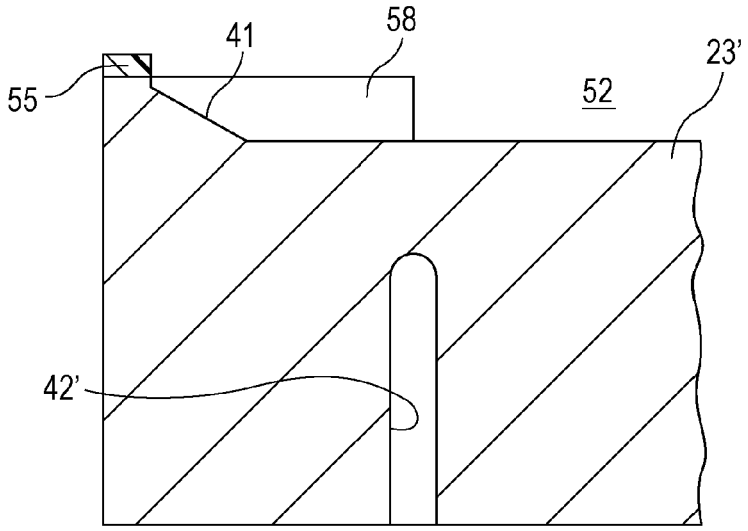
Figure 7C:
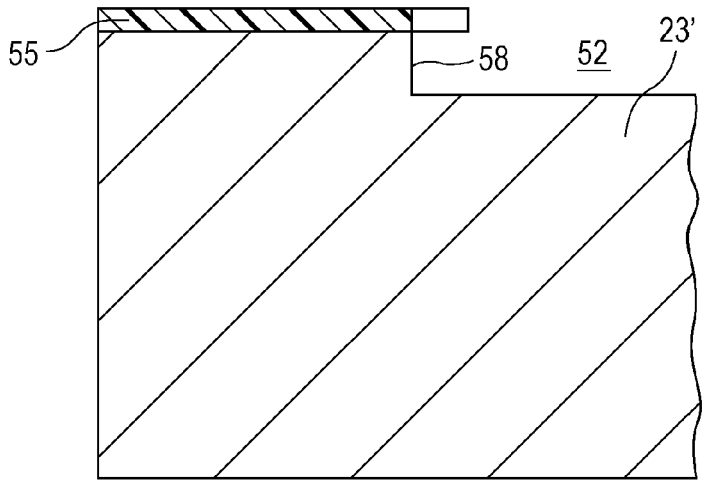
Figure 8A:
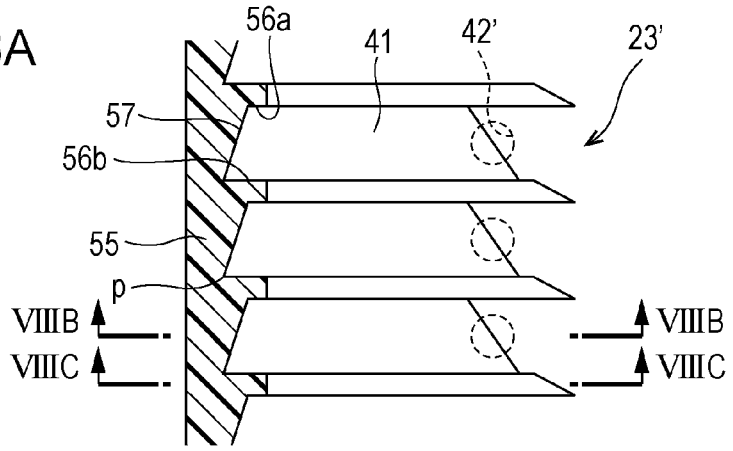
FIGS. 8A to 8C are views for describing the forming process of the second liquid chamber and the individual communication opening in the communication substrate.
Figure 8B:
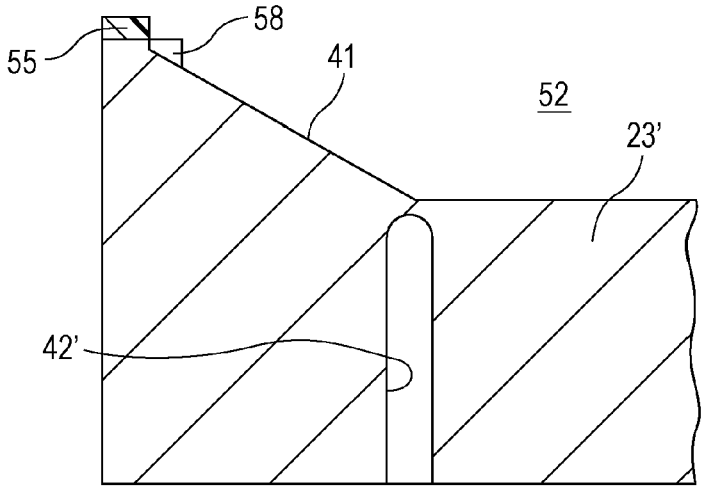
Figure 8C:
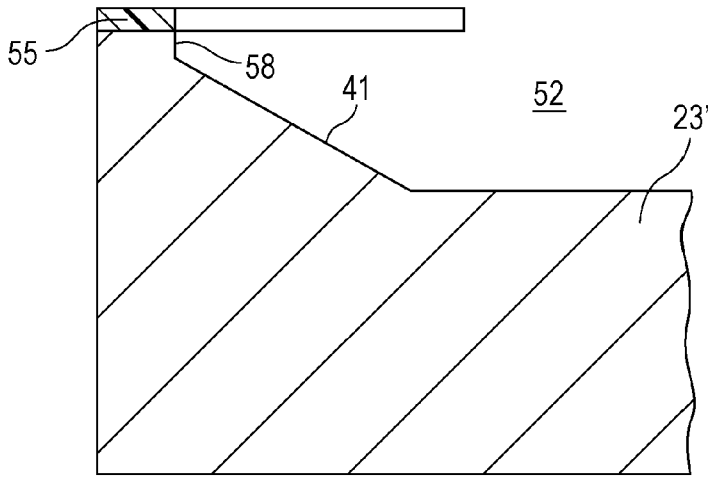
Figure 9A:
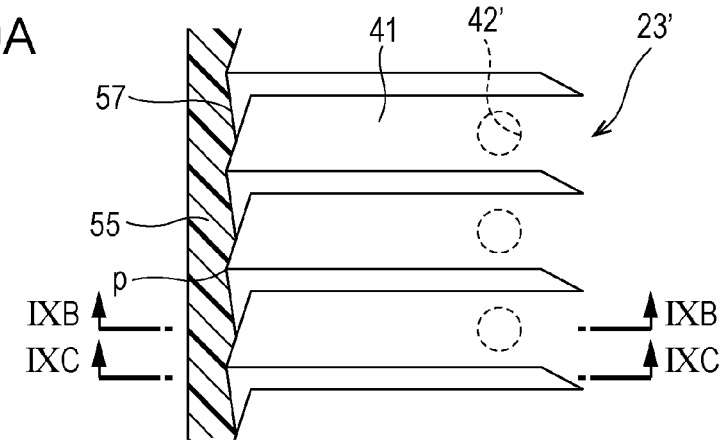
FIGS. 9A to 9C are views for describing the forming process of the second liquid chamber and the individual communication opening in the communication substrate.
Figure 9B:
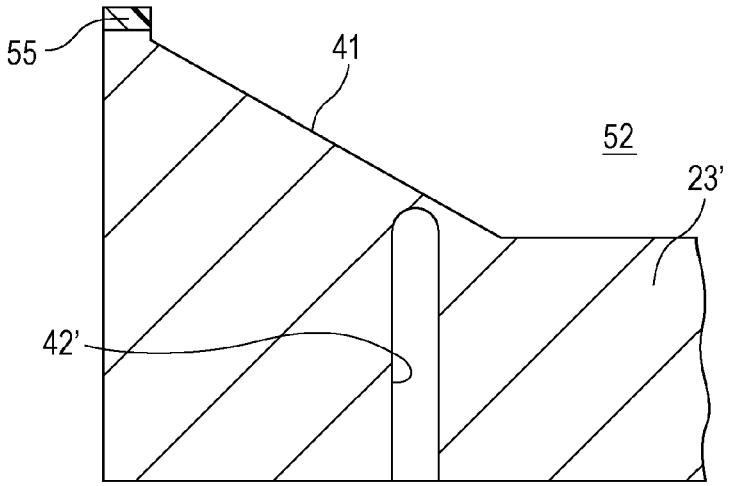
Figure 9C:
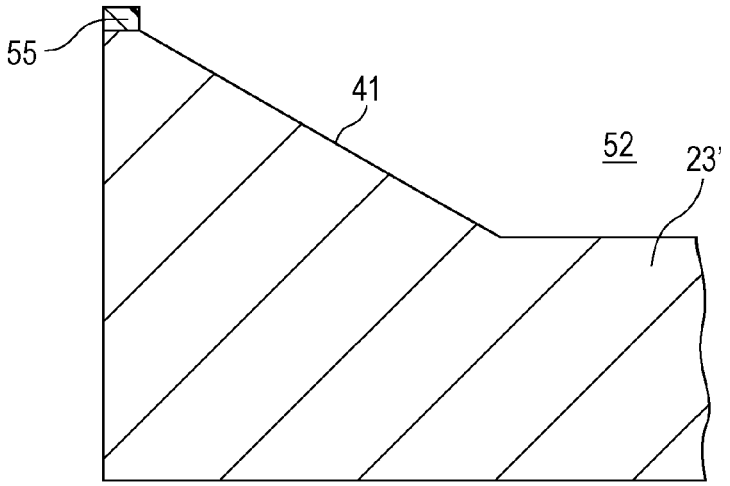

If the resist pattern 55 is formed, the etching is performed with respect to the surface ((110) plane) of the base material 23', for example, by using the etching solution which is made up of a potassium hydroxide (KOH) aqueous solution (third process). At this time, since an etching rate of the (111) plane is low with respect to an etching rate of the (110) plane, as illustrated in FIG. 7A to FIG. 7C, the (110) plane is mainly cut. In FIG. 7A to FIG. 7C, the plane which is parallel to the (110) plane is a portion which becomes the ceiling plane of the second liquid chamber 52 as described above. Here, in addition to the first (111) plane and the second (111) plane, a third (111) plane which inclines to the (110) plane by approximately 30 degrees and inclines to the first (111) plane by approximately 50 degrees is included in the silicon substrate being the base material 23'. Hence, as illustrated in FIG. 7A to FIG. 7C, the etching proceeds at the inclined plane forming prearranged position 41' which is surrounded by the first division patterns 56*a* and 56*b*, and the second division pattern 57, and thereby, the inclined plane 41 which is made up of the third (111) plane appears thereat. Moreover, a partition wall 58 that includes a side plane which is made up of the first (111) plane appears between the inclined plane forming prearranged positions 41' which are adjacent to each other. The resist pattern 55 is formed in the upper portion of the partition wall 58, but a side etching proceeds toward a root side (second division pattern 57 side) from an end plane (right end plane in FIG. 7B) of the first liquid chamber 51 side.

Figure 10A:
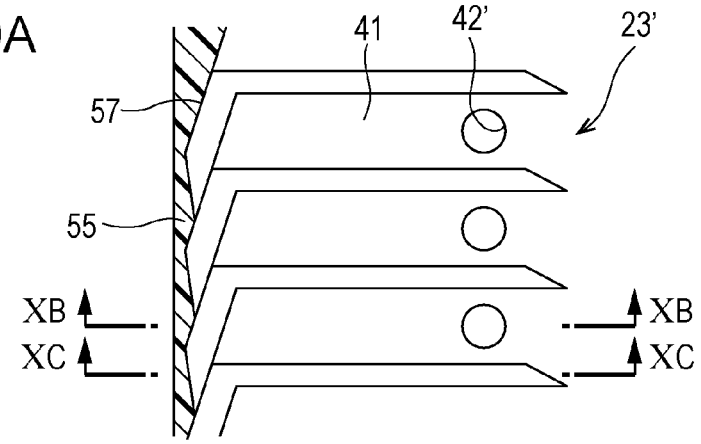
FIGS. 10A to 10C are views for describing the forming process of the second liquid chamber and the individual communication opening in the communication substrate.
Figure 10B:
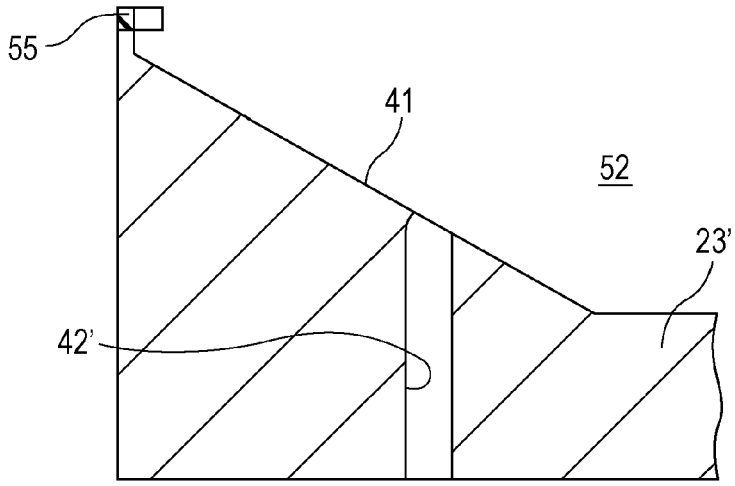
Figure 10C:
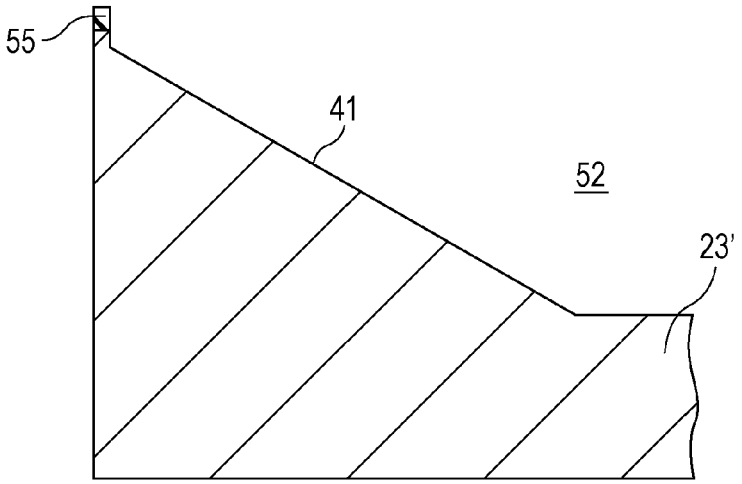
Figure 11A:
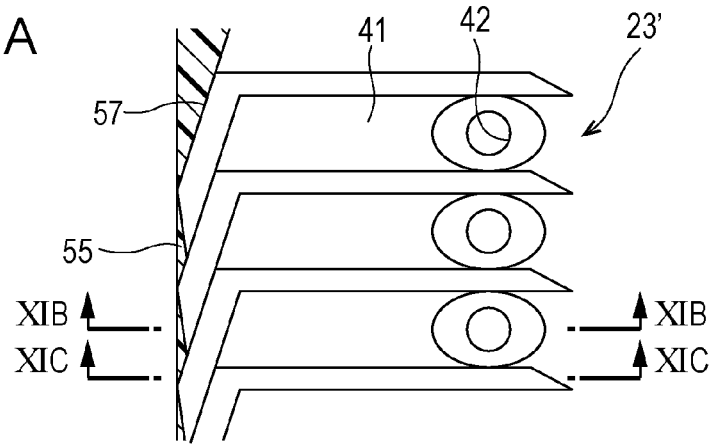
FIGS. 11A to 11C are views for describing the forming process of the second liquid chamber and the individual communication opening in the communication substrate.
Figure 11B:
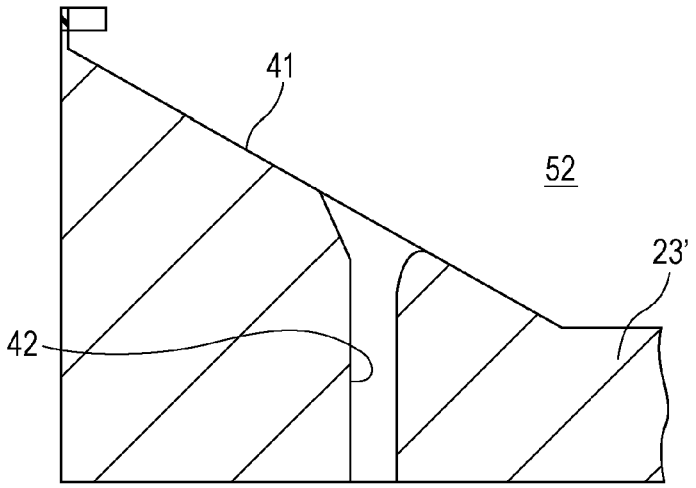
Figure 11C:
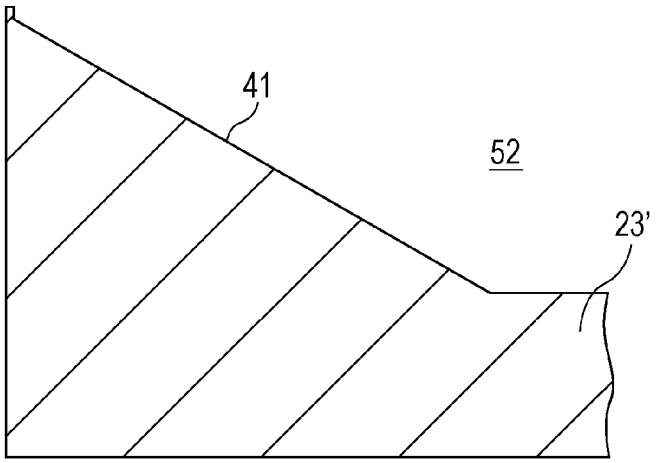
Figure 12:
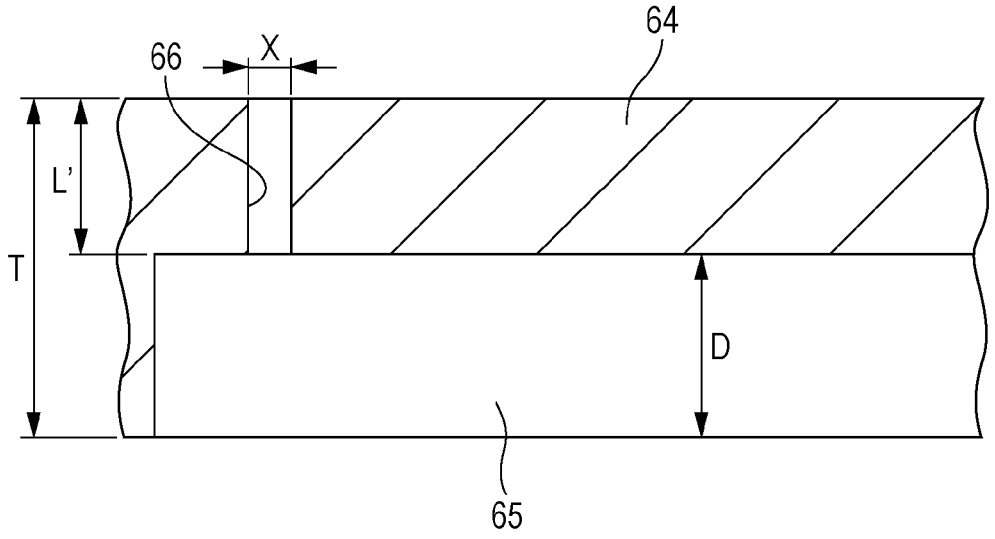
FIG. 12 is a sectional view of a main portion in the vicinity of an individual communication opening in a configuration of the related art.

Furthermore, if the etching proceeds, as illustrated in FIG. 8A to FIG. 9C, the inclined plane 41 being the third (111) plane is slowly cut in comparison with the (110) plane while maintaining the angle as the second liquid chamber 52 becomes deeper, and an edge thereof is gradually spread toward the first liquid chamber 51 side (right side in FIG. 7A to FIG. 7C). Hence, the upper end of the prepared hole 42', and the inclined plane 41 become gradually close to each other. Moreover, if the side etching of the partition wall 58 proceeds, and reaches up to the root portion, that is, the portion correlating with the second division pattern 57, the partition wall 58 disappears. Thereafter, the portion of the lower wall of the second division pattern 57 is gradually eroded (side-etched). Therefore, if the etching proceeds to a certain degree, as illustrated in FIG. 10A to FIG. 10C, one end of the prepared hole 42' is open in the middle of the inclined of the inclined plane 41, and the individual communication opening 42 is formed. If the etching proceeds after the prepared hole 42' (individual communication opening 42) is open onto the inclined plane 41, the opening portion is spread into almost a funnel shape by cutting the vicinity thereof. At the time of making such the state, the etching is finished. Thereafter, the extra resist pattern 55 is removed by hydrofluoric acid or the like, and becomes an individual communication substrate 23.

In this manner, since the silicon substrate being the base material 23' of the communication substrate 23 is a substrate of which the surface is used as a (110) plane, and the inclined plane 41 is configured by the third (111) plane which inclines to the (110) plane, it is possible to simultaneously form the inclined plane 41 at the time of forming the flow path hollow portion such as the second liquid chamber 52 by the anisotropic etching. Hence, there is no need of separately adding the process of forming the inclined plane 41.

Furthermore, in the above embodiments, the configuration that the opening of the common liquid chamber 32 is closed by the compliance sheet 25 on the lower plane of the communication substrate 23 is exemplified, but the configuration is not limited thereto. For example, it is possible to adopt a configuration that the opening of the common liquid chamber 32 is closed by the nozzle plate 22.

Therefore, in the above description, the flow path component of the invention is described by using the communication substrate 23 of the recording head 3 as an example, but the invention may be applied to other liquid discharge heads that includes the flow path component including the flow path hollow portion which is formed by making the hollow in the middle of the plate thickness direction toward the second plane of the opposite side of the first plane of the silicon substrate, and the individual flow path which penetrates the silicon substrate on the second plane side from the flow path hollow portion. For example, the invention may be applied to a color material discharge head which is used in manufacturing of a color filter such as a liquid crystal display, an electrode material discharge head which is used in forming of an electrode such as an organic electro luminescence (EL) display or a field emission display (FED), or a bio-organic matter discharge head which is used in manufacturing of a biochip (biotip).

What is claimed is:

1. A flow path component comprising:

a flow path hollow portion that is formed by making a hollow in the middle of a plate thickness direction toward a second plane side of the opposite side of a first plane of a silicon substrate; and an individual flow path that penetrates the silicon substrate on the second plane side from the flow path hollow portion, wherein a sum of a length L of the individual flow path and a substantial depth D of the flow path hollow portion in the thickness direction of the silicon substrate is greater than a thickness T of the silicon substrate.

2. The flow path component according to claim 1, wherein the flow path hollow portion includes an inclined plane which inclines toward the first plane from a bottom plane of the second plane side, and one end of the individual flow path is open onto the inclined plane.

3. The flow path component according to claim 2, wherein the silicon substrate is a substrate of which the first plane and the second plane are used as a (110) plane, and the inclined plane is made by a (111) plane which inclines toward the (110) plane.

4. A liquid discharge head comprising:

the flow path component according to claim 3; and a pressure chamber forming member where a pressure chamber communicating with a nozzle is formed, wherein the individual flow path communicates with the pressure chamber, and a liquid from the flow path hollow portion is supplied to the pressure chamber through the individual flow path.

5. A liquid discharge apparatus comprising:

the liquid discharge head according to claim 4.

6. A liquid discharge head comprising:

the flow path component according to claim 2; and a pressure chamber forming member where a pressure chamber communicating with a nozzle is formed, wherein the individual flow path communicates with the pressure chamber, and a liquid from the flow path hollow portion is supplied to the pressure chamber through the individual flow path.

7. A liquid discharge apparatus comprising:

the liquid discharge head according to claim 6.

8. The flow path component according to claim 1, wherein a relationship between a distance d which is up to a central axis of the individual flow path from the end of the individual flow path side in the flow path hollow portion and the substantial depth D of the flow path hollow portion is obtained by the following equation.

$$d \leq 1.73D$$

9. A liquid discharge head comprising:

the flow path component according to claim 8; and a pressure chamber forming member where a pressure chamber communicating with a nozzle is formed, wherein the individual flow path communicates with the pressure chamber, and a liquid from the flow path hollow portion is supplied to the pressure chamber through the individual flow path.

10. A liquid discharge apparatus comprising:

the liquid discharge head according to claim 9.

11. A liquid discharge head comprising:

the flow path component according to claim 1; and a pressure chamber forming member where a pressure chamber communicating with a nozzle is formed, wherein the individual flow path communicates with the pressure chamber, and a liquid from the flow path hollow portion is supplied to the pressure chamber through the individual flow path.

12. A liquid discharge apparatus comprising:

the liquid discharge head according to claim 11.

* * * * *